US007574775B2

(12) United States Patent
Zetti

(10) Patent No.: US 7,574,775 B2
(45) Date of Patent: Aug. 18, 2009

(54) SNAP HINGE FOR SUPPORTING A CLOSURE ELEMENT

(76) Inventor: Daniele Zetti, Via Monviso, 107, 41100 Modena (IT)

( * ) Notice: Subject to any disclaimer, the term of this patent is extended or adjusted under 35 U.S.C. 154(b) by 252 days.

(21) Appl. No.: 11/453,860

(22) Filed: Jun. 16, 2006

(65) Prior Publication Data

US 2007/0006420 A1 Jan. 11, 2007

(30) Foreign Application Priority Data

Jul. 7, 2005 (IT) ..... MO2005A0171

(51) Int. Cl.
*E05D 15/32* (2006.01)

(52) U.S. Cl. ..... 16/370; 16/286; 16/287; 16/288; 16/266; 16/294

(58) Field of Classification Search ..... 16/370, 16/277, 294, 366, 286, 287, 288; 312/319.1, 312/319.2, 326, 329
See application file for complete search history.

(56) References Cited

U.S. PATENT DOCUMENTS 4,470,169 A * 9/1984 Lautenschlager et al. ..... 16/291
6,308,376 B1 * 10/2001 Koshikawa ..... 16/250
6,499,189 B2 * 12/2002 Kondo et al. ..... 16/289
2001/0025398 A1 * 10/2001 Zetti ..... 16/370
2003/0213098 A1 * 11/2003 Cummins et al. ..... 16/286

FOREIGN PATENT DOCUMENTS

EP 1 138 857 A1 10/2001
EP 1138857 A1 * 10/2001
EP 1741860 A1 * 1/2007

* cited by examiner

*Primary Examiner*—Victor Batson
*Assistant Examiner*—Emily M Morgan
(74) *Attorney, Agent, or Firm*—Modiano & Associati; Albert Josif; Daniel J. O'Bryne

(57) ABSTRACT

A snap hinge for supporting a closure element, which comprises a first articulated quadrilateral and a second articulated quadrilateral, which share a first lever and a second lever, which have as their base element respectively a plate for coupling to a fixed element and a plate for fixing to a closure element, an elastic element acting between a point of the first lever and a point of the second lever, and an auxiliary elastic element, arranged in series to the elastic element and has one end articulated to the first lever and the opposite end articulated to an abutment element rigidly associated with the coupling plate.

12 Claims, 3 Drawing Sheets

SNAP HINGE FOR SUPPORTING A CLOSURE ELEMENT

The present invention relates to a snap hinge for supporting a closure element.

BACKGROUND OF THE INVENTION

In the field of interior furniture, it is known to use snap hinges which are suitable for the rotation of a closure element about a substantially horizontal or inclined axis, such as for example snap hinges used to open and close doors on cabinets arranged inside caravans or the like.

Known snap hinges comprise a first articulated quadrilateral and a second articulated quadrilateral, which share a first lever and a second lever and have as their base element respectively a plate for coupling to a fixed element of a piece of furniture or the like and a plate for fixing to the closure element.

Further, known snap hinges comprise a spring which acts between two mutually opposite points of one of the two articulated quadrilaterals.

Each of the two articulated quadrilaterals is constituted by the first and second levers, by an arm and by a base element, respectively the coupling plate or the fixing plate, which are mutually articulated. The spring acts between a contact and articulation point on the first lever and a contact and articulation point on the second lever.

Again with reference to pieces of furniture such as cabinets for the interior furnishing of caravans or the like, the coupling plate is anchored to the wall that delimits in an upper region the cabinet and on the surface that faces the internal compartment thereof.

The fixing blade is anchored to the door on the surface that is designed to face, in the closed configuration of the door, the compartment of the cabinet.

The coupling plate and the fixing plate are fixed generally by way of threaded means such as screws.

In the open configuration, the spring of the snap hinge acts in contrast to the weight force of the door and therefore has a supporting function for said door.

In the closure configuration, the elastic action applied by the spring is suitable to keep the door in a position for closing the compartment of the cabinet.

The above described snap hinges are not free from drawbacks, including the fact that in the open configuration the spring that acts in opposition to the weight force of the door is subject to partial compression and does not ensure the maximum opening of said door with respect to the cabinet, consequently hindering user access to the content of the compartment.

Also with particular reference to the application of said hinges to doors and cabinets for the interior furnishing of caravans or the like, a further drawback is that the elastic action applied by the spring and suitable to keep the door in a position for closing the compartment of the cabinet is not such as to prevent the accidental opening of the door, for example, when the caravan or the like is moving and on bends, with the consequent escape of the contents from the cabinet.

A second known type of snap hinge comprises two articulated quadrilaterals and has two springs which are arranged in series or in parallel to each other and, with particular reference to cabinets for caravans or the like, provide a more stable and safe support of the door, both in the open configuration and in the closed configuration, with respect to hinges that comprise a single spring.

If the springs are arranged parallel to each other, they act between two mutually opposite points of a same articulated quadrilateral, whereas if they are arranged in series they act between two mutually opposite points of a respective articulated quadrilateral.

In these last hinges, the plate for coupling to the fixed structure of a piece of furniture or the like is bridge-shaped.

With particular reference again to cabinets for caravans or the like, the bridge-shaped coupling plate is suitable for the anchoring of the hinge to a supporting element which is rigidly fixed to the wall that delimits in an upper region the cabinet and to the inside of the compartment. Said bridge-shaped coupling plate is arranged, in the closed configuration of the hinge, on a plane of arrangement which is substantially perpendicular to the door.

Said hinges are not free from drawbacks, the first of which is high structural complexity due to the particular type of anchoring by means of the coupling plate, with consequent significant production costs.

Moreover, in order to anchor the hinge to the cabinet or the like it is necessary to use an additional supporting element, which is fixed to one of the walls of said cabinet, thus limiting the possibilities of use of the hinge.

SUMMARY OF THE INVENTION

The aim of the present invention is to eliminate the drawbacks mentioned above of known hinges, by providing a snap hinge which allows a stable and safe support of a closure element with respect to the structure of a piece of furniture or the like both in a closed configuration and in an open configuration of the hinge, while limiting the structural complexity of said hinge.

Within this aim, an object of the present invention is to provide a snap hinge which is simple, relatively easy to provide in practice, safe in use, effective in operation, and has a relatively low cost.

This aim and these and other objects that will become better apparent hereinafter are achieved by the present snap hinge for supporting a closure element, which comprises a first articulated quadrilateral and a second articulated quadrilateral, which share a first lever and a second lever, which have as their base element respectively a plate for coupling to a fixed element and a plate for fixing to a closure element, elastic means acting between a point of the first lever and a point of the second lever, characterized in that it comprises auxiliary elastic means, which are arranged in series to the elastic means and have one end articulated to the first lever and the opposite end articulated to an abutment element which is rigidly associated with the coupling plate.

BRIEF DESCRIPTION OF THE DRAWINGS

Further characteristics and advantages of the present invention will become better apparent from the following detailed description of a preferred but not exclusive embodiment of a snap hinge for supporting a closure element, illustrated by way of non-limiting example in the accompanying drawings, wherein.

DESCRIPTION OF THE PREFERRED EMBODIMENTS

Figure 2:
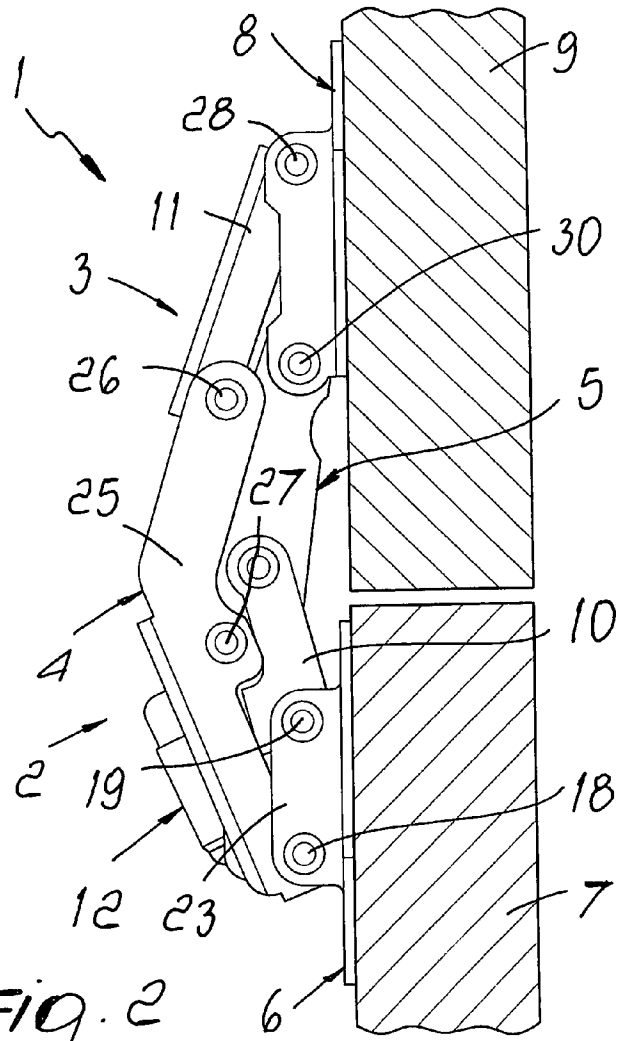
FIG. 2 is a side view of the hinge according to the invention, in an open configuration.
Figure 1:
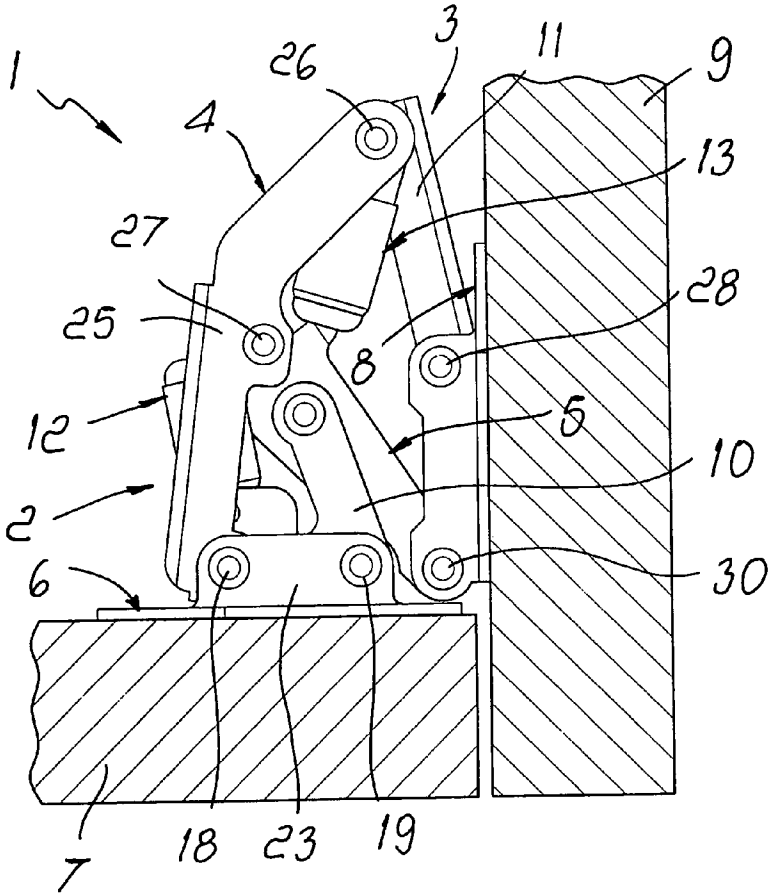
FIG. 1 is a side view of the hinge according to the invention, in a closed configuration.
Figure 4:
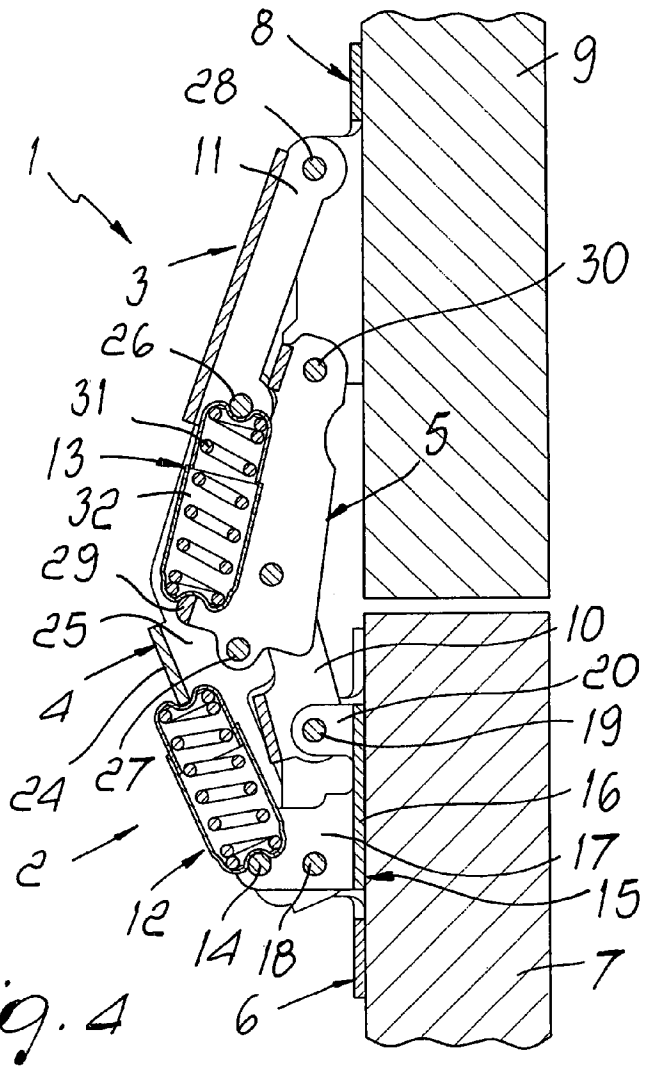
FIG. 4 is a sectional view of the hinge according to the invention, in an open configuration.
Figure 3:
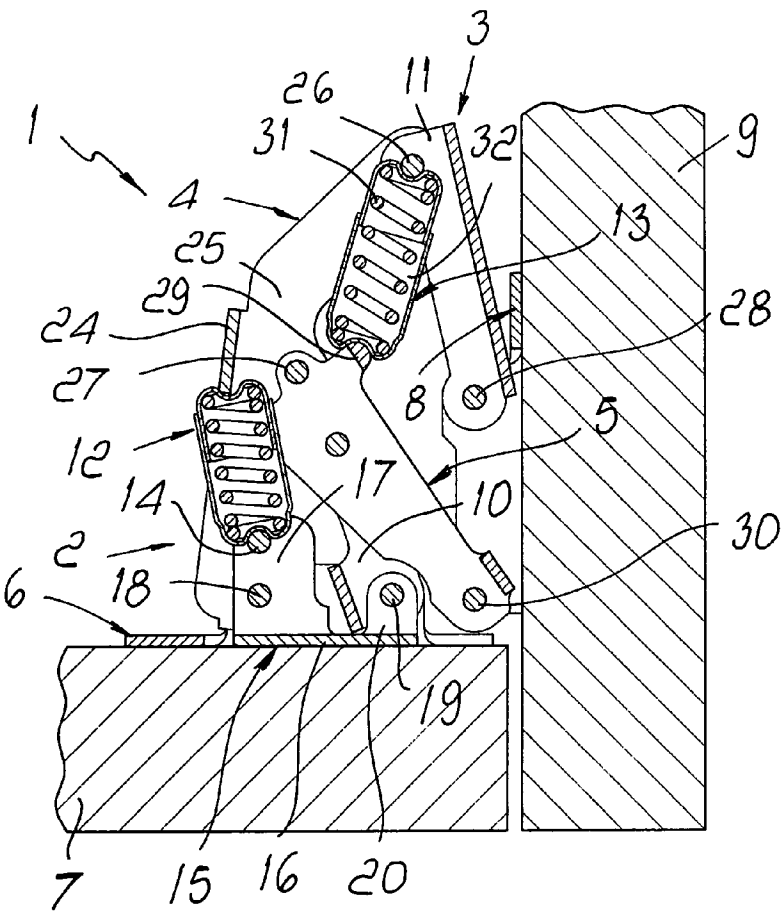
FIG. 3 is a sectional view of the hinge according to the invention, in a closed configuration.
Figure 5:
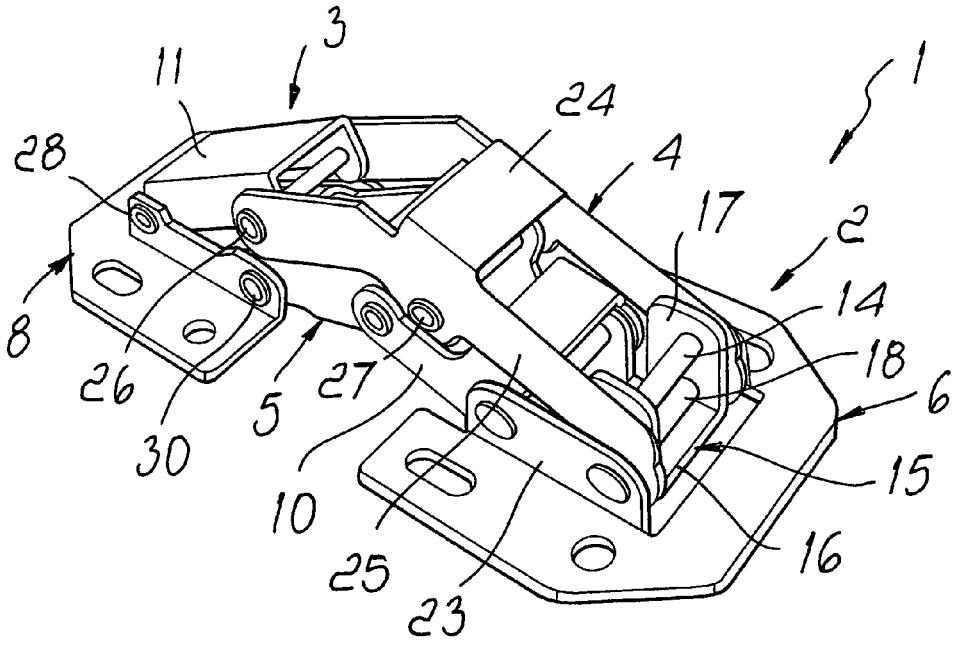
FIG. 5 is an axonometric view of the hinge according to the invention.
Figure 6:
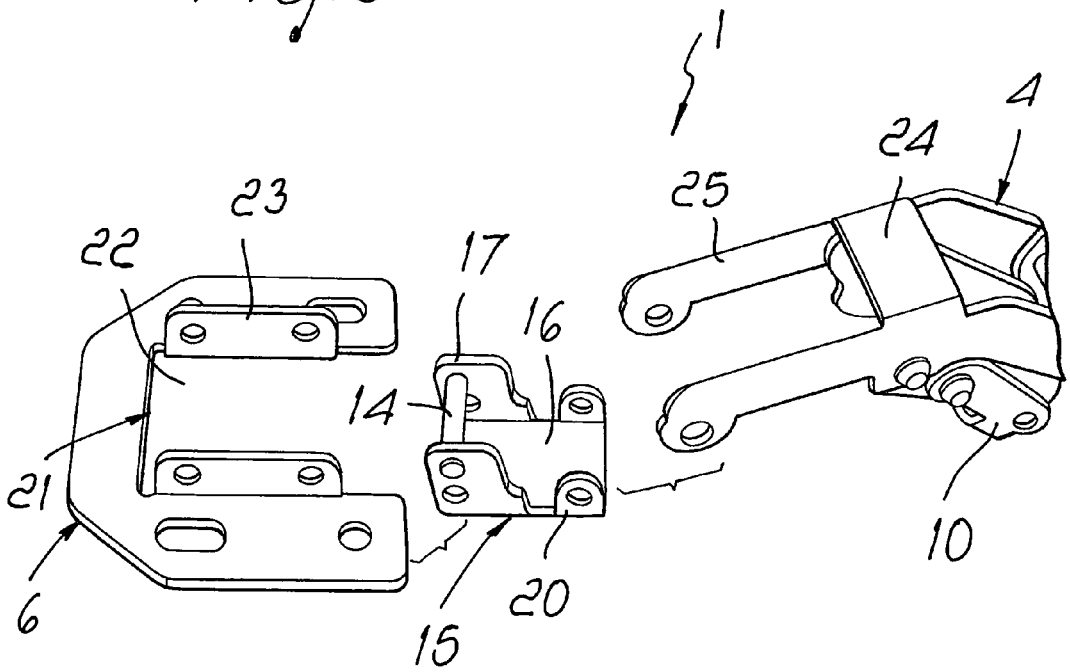
FIG. 6 is an axonometric exploded view of a detail of the hinge according to the invention.

With reference to the figures, the reference numeral 1 designates a snap hinge.

The hinge 1 comprises a first articulated quadrilateral 2 and a second articulated quadrilateral 3, which share a first lever 4 and a second lever 5 and have as their base element respectively a plate 6 for coupling to a fixed element 7 and a plate 8 for fixing to a closure element 9.

With particular but not exclusive reference to cabinets for caravans or the like, the fixed element 7 is constituted by the wall that delimits in an upper region said cabinet and the coupling plate 6 is anchored to the surface of said wall that faces the internal compartment.

The closure element 9 is instead constituted by a door, and the fixing plate 8 is anchored thereto on the surface that is designed to face the compartment when the door is arranged in a position for closing the cabinet.

Each of the articulated quadrilaterals 2, 3 further comprises a respective arm.

In particular, the first articulated quadrilateral 2 comprises the coupling plate 6, the first lever 4, the second lever 5 and a first arm 10, which are mutually articulated.

The second articulated quadrilateral 3 comprises the fixing plate 8, the first lever 4, the second lever 5, and a second arm 11, which are mutually articulated.

Elastic means 12 and auxiliary elastic means 13 are arranged in series to each other and act respectively between a point of the first lever 4 and a point of the second lever 5 and between a point of the first lever 4 and an abutment element rigidly associated with the coupling plate 6.

In particular, the abutment element comprises a first pivot 14, which is supported by a supporting element 15, which is rigidly associated with the coupling plate 6 and to which the end of the auxiliary elastic means that lies opposite the end associated with the first lever 4 is articulated.

Advantageously, the supporting element 15 comprises a flat portion 16, which is parallel to the plane of arrangement of the coupling plate 6. Two first lugs 17 protrude from the two opposite edges of the flat portion 16 in order to support the opposite axial ends of the first pivot 14.

A second pivot 18 and a third pivot 19 are further associated with the supporting element 15 for the articulation of one end of the first lever 4 and of one end of the first arm 10, respectively.

In particular, the pair of first lugs 17 has holes suitable to support the axial ends of the second pivot 18.

Two second lugs 20 protrude from the two opposite edges of the flat portion 16 and have respective holes suitable to support the axial ends of the third pivot 19.

Advantageously, the second and third pivots 18 and 19 are substantially parallel to the first pivot 14.

The supporting element 15 is arranged within a suitable receptacle 21, which is formed in the coupling plate 6 and comprises an opening 22. Two side walls 23 protrude along two edges which delimit the opening 22, are substantially parallel to each other and support the flat portion 16.

In particular, each of the two side walls 23 is provided with two holes, which correspond substantially to the holes of the first and second pair of lugs 17, 20 and are suitable for the insertion of the opposite ends of the second pivot 18 and of the third pivot 19 respectively.

Advantageously, the second and third pivots 18, 19 have a head-shaped end and a riveted opposite end.

The first lever 4 comprises a dorsal bridge 24, which is formed monolithically by the opposite edges of two sides 25 which are substantially parallel to each other.

The sides 25 are provided, at one end, with holes which are suitable for the insertion of the axial ends of the second pivot 18 for articulation to the supporting element 15. At the opposite end, the sides 25 are provided with holes for articulation to the second arm 11 about a fourth pivot 26. A fifth pivot 27 is supported by holes which are formed in the sides 25 proximate to the dorsal bridge 24, and the second lever 5 is articulated about said fifth pivot.

The edge of the dorsal bridge 24 that is directed toward the coupling plate 6 forms a point for the articulation of the end of the auxiliary elastic means 13 which lies opposite the end that is articulated to the first pivot 14.

The second arm 11 is articulated, at its end that lies opposite the end that is articulated to the first lever 4, to the fixing plate 8 about a sixth pivot 28.

The second lever 5 comprises, proximate to its end that is articulated to the first lever 4, a tab 29; the elastic means 12 act between the tab 29 and the fourth pivot 26.

At the opposite end, the second lever 5 is articulated to a seventh pivot 30, which is supported by the fixing plate 8 and is arranged substantially parallel to the sixth pivot 28.

The elastic means 12 and the auxiliary elastic means 13 each comprise at least one spring 31 and two guiding elements 32 for the spring 31, which are coupled so that they can slide axially with respect to each other.

In particular, the elastic means 12 and the auxiliary elastic means 13 are of the type of elastic telescopic capsules, and the two guiding elements 32 are constituted respectively by backplates and lids between which the helical-type spring 31 acts and is contained.

As an alternative, the guiding elements 32 are constituted by a cylinder and a piston, which are connected slidingly to each other at one end and are provided with heads at the respective opposite ends. The spring 31 is of the helical type and is fitted coaxially on the cylinder and on the piston and acts between the two heads.

In practice it has been found that the described invention achieves the proposed aim and objects, and in particular the fact is stressed that the use of auxiliary elastic means arranged in series to the elastic means allows a stable support of the closure element both in a closed consideration and in an open configuration of the hinge.

The limited structural complexity of the invention being considered, further allows to achieve reduced production costs for the hinge in relation to its new function (which is due to the additional spring).

The invention thus conceived is susceptible of numerous modifications and variations, all of which are within the scope of the appended claims.

All the details may further be replaced with other technically equivalent elements.

In practice, the materials used, as well as the contingent shapes and dimensions, may be any according to requirements without thereby abandoning the scope of the protection of the appended claims.

The disclosures in Italian Patent Application No. M02005A000171 from which this application claims priority are incorporated herein by reference.

What is claimed is:

1. A snap hinge for supporting a closure element, comprising: a first articulated quadrilateral; a second articulated quadrilateral, a first lever and a second lever, said first and second levers being each pivoted to said first and second quadrilaterals, so as to mutually connect said first and second quadrilaterals, said first and second levers being hinged together; said first articulated quadrilateral comprising a coupling plate for coupling the first lever to a fixed element; said second articulated quadrilateral comprising a fixing plate for fixing the second lever to a closure element; elastic means acting between a point of said first lever and a point of said second lever; an abutment element which is rigidly associated with said coupling plate; and auxiliary elastic means, which are arranged in series to said elastic means and have a first end articulated to said first lever and a second opposite end articulated to said abutment element, wherein said abutment element comprises a first pivot, and a supporting element for supporting said first pivot and which is rigidly associated with said coupling plate, wherein said coupling plate comprises a receptacle for accommodating said supporting element.

2. The hinge of claim 1, wherein said supporting element comprises a flat portion which is arranged parallel to a plane of arrangement of said coupling plate and a pair of first lugs which protrude from two opposite edges of said flat portion in order to support opposite ends of said first pivot.

3. The hinge of claim 2, comprising a second pivot for articulation of one end of said first lever that is pivoted to with said supporting element.

4. The hinge of claim 2, wherein said pair of first lugs is provided with holes for supporting an end of said second pivot, said second pivot being arranged substantially parallel to said first pivot.

5. The hinge of claim 3, comprising a third pivot for articulation of one end of an arm of said first articulated quadrilateral that is associated with said supporting element.

6. The hinge of claim 5, wherein said supporting element comprises a pair of second lugs, which protrude from said two opposite edges of said flat portion and are provided with holes for supporting ends of said third pivot, said third pivot being substantially parallel to said first pivot.

7. The hinge of claim 1, wherein said receptacle comprises an opening, that has two edges with two substantially mutually parallel side walls therealong, said flat portion being anchored to said side walls.

8. The hinge of claim 7, wherein each one of said two side walls is provided with two holes which correspond to said holes of said first pair of lugs and of said second pair of lugs and are suitable for insertion therein of opposite ends of said second and third pivots, respectively.

9. The hinge of claim 3, comprising a fourth pivot for mutually pivoting said first and second levers, said first lever comprising two mutually parallel sides, and a dorsal bridge which is formed monolithically by the opposite edges of said sides and is formed proximate to said fourth pivot, an edge of said dorsal bridge directed toward said coupling plate forming an articulation point for an end of said auxiliary elastic means that lies opposite an end that is articulated to said first pivot.

10. The hinge of claim 1, wherein said auxiliary elastic means comprise at least one spring.

11. The hinge of claim 10, wherein said spring is a helical spring.

12. The hinge of claim 11, wherein said auxiliary elastic means comprise two elements for guiding said spring, which are mutually coupled so as to be slideable axially with respect to each other.

* * * * *